United States Patent [19]

Rüter

[11] 4,143,093

[45] Mar. 6, 1979

[54] POLYESTER THREADS AND FIBERS HAVING INCREASED DYE AFFINITY

[75] Inventor: Jörn Rüter, Marl, Fed. Rep. of Germany

[73] Assignee: Chemische Werke Hüls AG, Marl, Fed. Rep. of Germany

[21] Appl. No.: 889,419

[22] Filed: Mar. 23, 1978

[30] Foreign Application Priority Data

Apr. 7, 1977 [DE] Fed. Rep. of Germany ..... 2715673

[51] Int. Cl.[2] ..... C08L 67/02

[52] U.S. Cl. ..... 260/860; 8/179; 264/78

[58] Field of Search ..... 260/873, 860; 428/395

[56] References Cited

U.S. PATENT DOCUMENTS 3,988,387 10/1976 Chimura et al. ..... 260/280

FOREIGN PATENT DOCUMENTS 2502555 7/1976 Fed. Rep. of Germany.

OTHER PUBLICATIONS

Polyester Fibres, Chem. & Tech., Ludewig, (Wiley-InterScience), pp. 95–135; 205–217.

*Primary Examiner*—Thomas De Benedictis, Sr.
*Attorney, Agent, or Firm*—Gilbert L. Wells

[57] ABSTRACT

Textile fibers and articles having increased dye affinity are prepared by spinning a mixture of 85–97% by weight of poly(ethylene terephthalate) or poly(1,4-cyclohexylenedimethylene terephthalate) and 3–15% by weight of poly(ethylene dodecanedioate) and after-treating the spun threads in a conventional spun threads in a conventional way.

3 Claims, No Drawings

POLYESTER THREADS AND FIBERS HAVING INCREASED DYE AFFINITY

CROSS REFERENCE TO A RELATED APPLICATION

Applicant claims priority under 35 USC 119 for application P 27 15 673.6 filed Apr. 7, 1977 in the Patent Office of the Federal Republic of Germany.

BACKGROUND OF THE INVENTION

The present invention relates to polyester fibers having improved dyeability and particularly to threads and fibers of high-molecular, linear polyesters of poly(ethylene terephthalate) and poly(1,4-cyclohexylenedimethylene terephthalate).

The state of the art of preparing and dyeing poly (ethylene terephthalate) and poly(1,4-cyclohexylenedimethylene terephthalate) fibers may be ascertained by reference to U.S Pat. No. 3,988,387; German Published Application No. 2,502,555 and the book of H. Ludewig, "Polyesterfasern", Akademie Publishers Berlin (1975), pp. 95 et seq. and 199 et seq., the disclosures of which are incorporated herein. The production of the poly(ethylene dodecanedioate) useful in the present invention is possible by the esterification and polycondensation of ethylene glycol and dodecanedioic acid in the same way as it is disclosed for polyesters by Korshak and Vinogradova in "Polyesters", page 153 ff (Pergamon Press 1965).

Threads and fibers of high-molecular, linear polyesters, such as poly(ethylene terephthalate) or poly(1,4-cyclohexylenedimethylene terephthalate) have found widespread use for a great variety of textile applications due to their excellent properties.

The great disadvantage inherent in these threads and fibers, however, resides in that difficulties are encountered when dyeing same in a normal dyeing procedure. Therefore, it has been necessary to either dye textile articles from poly(ethylene terephthalate) or poly(1,4-cyclohexylenedimethylene terephthalate) under pressure at temperatures above the boiling point of the dye bath (HT dyeing) or to conduct the dyeing step in the presence of a carrier.

Apart from the increased expenses involved in such processes, the HT dyeing method cannot be utilized, due to the required high temperatures, for example for polyester-wool mixtures or in the piece-dyeing of carpets. Besides, there is an increasing desire for entirely omitting the use of carriers in the dyeing of polyester threads and fibers, for reasons of environmental protection and prevention of wastewater pollution. Therefore, great efforts have been made to develop polyesters, primarily on the basis of terephthalic acid, ethylene glycol, and 1,4-bis(hydroxymethyl)cyclohexane, which can be thoroughly dyed without the use of HT conditions or a carrier.

The customary method resides in incorporating into the polyester chain of poly(ethylene terephthalate) or poly(1,4-cyclohexylenedimethylene terephthalate) other dicarboxylic acids, such as isophthalic acid, adipic acid, azelaic acid, or dodecanedioic acid, or other diols, such as 1,3-propanediol, 1,4-butanediol, neopentyl glycol, or 1,6-hexanediol, whereby the crystalline structure of the polyesters is disturbed and dye absorption is improved. The disadvantage of this method resides in that the incorporation of these concomitant components into poly(ethylene terephthalate) or poly(1,4-cyclohexylenedimethylene terephthalate) also results in an impairment of the excellent mechanical and thermal properties of the basic polymers. These copolyester threads and fibers are, therefore, no longer usable for certain fields of application wherein these properties are required.

Another process resides in incorporating by blending, during the spinning step, poly(butylene terephthalate), which as is known can be dyed without the use of carriers, into poly(ethylene terephthalate), thus producing polyester threads having an improved dye affinity as disclosed in U.S. Pat. No. 3,988,387 and German Published Application No. 2,502,555. However, it is known from the literature (Polymer 17 (12):1044 [1976]) that poly(butylene terephthalate) is rapidly degraded at high temperatures, splitting off butadiene and low-molecular products. High temperatures are inherently reached during the melt spinning of poly(ethylene terephthalate) and especially of poly(1,4-cyclohexylenedimethylene terephthalate), the melting point of which is about 300° C. A thermal degradation of mixed-in poly(butylene terephthalate) can thus lead to a reduction in viscosity of the total mixture and consequently to an impairment of the mechanical and textile properties of the polyester threads.

SUMMARY OF THE INVENTION

Having in mind the limitations of the prior art, it is an object of the present invention to prepare polyester threads and fibers having increased dye affinity from poly(ethylene terephthalate) and poly(1,4-cyclohexylenedimethylene terephthalate).

The object of the present invention is achieved by spinning a mixture of about 85–97% by weight of poly(ethylene terephthalate) or poly(1,4-cyclohexylenedimethylene terephthalate) and about 3–15% by weight of poly(ethylene dodecanedioate) and aftertreating the spun threads in a conventional way.

DESCRIPTION OF THE PREFERRED EMBODIMENTS

It has been found surprisingly that threads and fibers according to this invention are improved in their dye receptivity with respect to disperse dyes to such an extent that they can be dyed without the use of a carrier in the conventional dyeing process at 100° C. without observing any reduction in viscosity of the mixture during the manufacture of the threads and fibers.

The poly(ethylene terephthalate) and the poly(1,4-cyclohexylenedimethylene terephthalate) utilized for the process of this invention are produced in accordance with the known methods, for example by interesterification of dimethyl terephthalate with ethylene glycol and/or 1,4-bis(hydroxymethyl)cyclohexane and subsequent polycondensation. These manufacturing methods are described, for example, in detail in H. Ludewig, "Polyesterfasern" [Polyester Fibers]. Akademie publishers, Berlin, 1975, pp. 95 et seq. and 199 et seq.

These polyesters can contain, in the acid component, additionally to terephthalic acid also minor amounts, for example about up to 5 mol percent, of another dicarboxylic acid, such as isophthalic acid, adipic acid, sebacic acid, azelaic acid, hexahydroterephthalic acid, or dodecanedioic acid. They are to exhibit reduced specific solution viscosity values (RSV value, measured as a 0.23% solution in phenol/tetrachloroethane 60/40 at 25° C.) of 0.5–1.1, preferably 0.6–0.9 dl./g.

The poly(ethylene dodecanedioate) utilized for the process of this invention is likewise prepared in accordance with the conventional polycondensation methods. The most advantageous process resides in esterifying dodecanedioic acid with an excess of ethylene glycol at temperatures around 180° C. and polycondensing the esterification mixture thereafter at temperatures around 280° C. and under a pressure of below 1 mbar, with the addition of suitable polycondensation catalysts, such as antimony trioxide, germanium dioxide, or titanium alcoholates.

The RSV value of poly(ethylene dodecanedioate) should be in the range of 0.4–1.5, preferably 0.7–1.1 dl./g.

The procedure of the invention is conducted by melting, in a customary melt spinning apparatus, a granulated mixture of 15–3%, preferably 10–5% by weight of poly(ethylene dodecanedioate), on the one hand, and 85–97%, preferably 90–95% by weight of poly(ethylene terephthalate) or poly(1,4-cyclohexylenedimethylene terephthalate), on the other hand, and spinning the mixture into threads in the usual way. The melt spinning step is followed by the conventional process steps of stretching, fixation, optionally crimping, and cutting to staple fiber length. The conditions used in all of these process steps differ nowise from the conditions customarily utilized in the spinning of pure poly(ethylene terephthalate) or poly(1,4-cyclohexylenedimethylene terephthalate).

The great advantage of the process of this invention resides in that it is unnecessary to employ an expensive copolycondensation process for manufacturing the polyester threads and fibers which can be dyed without a carrier; rather, it is merely necessary to produce a granulated mixture of available polyesters which can be spun directly.

Since the additive poly(ethylenedodecanedioate) is merely blended into the basic polyesters poly(ethylene terephthalate) or poly(1,4-cyclohexylenedimethylene terephthalate), the mechanical and particularly the thermal properties of the basic polyesters are extensively preserved, as can clearly be seen from the DSC analyses of the examples. This means that the lowering in the melt and glass transition temperatures always observed in copolyesters does not occur. The special advantage of the process of this invention resides in that the poly(ethylene dodecanedioate) employed is of such a thermal stability at the spinning temperatures of poly(ethylene terephthalate) or poly(1,4-cyclohexylenedimethylene terephthalate) that the polymer mixture does not suffer a reduction in viscosity, either.

The dye affinity of the polyester threads and fibers produced according to this invention without a carrier is tested in the dyeing process described hereinbelow.

The polyester threads and fibers are dyed in the form of 10-gram skeins with three different dye recipes (a) "FORON" Yellow Brown 2 RFL (Commercial disperse dye, Sandoz Company)
(b) "RESOLIN" Red BBL (Commercial disperse dyes, Bayer AG)
(c) "RESOLIN" Blue RRL (Commercial disperse dyes, Bayer AG)

using a dye liquor having the following composition:

2% disperse dye (based on the fiber weight)
400 ml distilled water
1% "UNIPEROL W" (Commercial conditioning agent, BASF Company) (based on the fiber weight
Formic acid (to pH 5)
2 g./l. ammonium sulfate
No carrier,
liquor ratio 1:40,
duration of dyeing step: a2 hours at 100° C.

The thus-dyed skeins are cleaned with a solution of:

3 ml/l. sodium hydroxide solution, 38° Be
2 g./l. hydrosulfite
0.3 ml/l. "EKALIN F" (Commercial dispersing agent, Sandoz Company)

for 20 minutes at 70° C., then rinsed repeatedly warm and cold and then dried.

Since the dyeing action thus obtained is very intense, the dye yield is suitably determined indirectly via the determination of the dye remaining in the dye bath (exhaustive dyeing). For this purpose, the dye bath is filled up with distilled water to the original volume, cooled to 70° C., combined with lg./l. of "LEVEGAL PT" (Commercial carrier, Bayer AG.), and decolorized exhaustively with 10 g. staple fiber yarn on the basis of poly (1,4-cyclohexylenedimethylene terephthalate) for 1 hour at 100° C. The yarn specimens are rinsed repeatedly and dried. The exhaustive dyeing products can be readily compared visually with a series of comparative specimens dyed under identical conditions with definite amounts of the same dyes; in this way the dye quantity applied during the exhaustive dyeing process is determined, which can be used to calculate the dye yield of the main dyeing step in % of the quantity of dye employed.

EXAMPLE 1

Preparation of Poly(ethylene dodecanedioate)

8.05 kg. of dodecanedioic acid and 6.5 kg. of ethylene glycol are esterified in an agitated vessel for 3 hours at 180°–200° C. in a nitrogen stream until the acid number of the mixture is ~2 mg. KOH/g.

The mixture is combined with 3.88 g. of antimony trioxide and 7.76 g. of triphenyl phosphate, heated to 250° C. and maintained for 1 hour at this temperature. Subsequently, the mixture is heated to 280° C., while applying a vacuum, and polycondensed upon reaching 0.5 mbar for 3 hours at 280° C. The melt is cooled to 200° C. under agitation, forced through a nozzle, and thus granulated by extrusion. In this way, cylindrical granules are obtained consisting of poly(ethylene dodecanedioate) having an RSV value of 0.86 dl./g. and a DTA [differential thermal analysis] melting point of 80° C. For further use, the granules are dried for 24 hours at 75° C./0.5 mbar.

EXAMPLE 2

2,850 g. of a dried poly(ethylene terephthalate), RSV value 0.67 dl./g. in granulated form is mixed with 150 g. of the poly(ethylene dodecanedioate) granules produced in Example 1. The mixture is spun in a laboratory melt spinning apparatus through a spinneret with 20 holes having a diameter of 0.25 mm. at 305° C. spinning temperature (product temperature in the spinning head) into threads which are wound up at a take-off speed of 640 m./min. Thereafter, the threads are drawn with the use of a heated iron in one step in the hot state with a drawing ratio of 1:4.0. The threads have the following properties after this procedure:

Titer: 87/20 dtex
Tensile strength: 3.4 cN/dtex
Tensile elongation: 31%

The table indicates the dye yield determined in accordance with the above-described method, the measured values for the DSC analysis, and the RSV value of the threads.

EXAMPLE 3

Example 2 is repeated with the use of a granulated mixture of 2,760 g. of poly(ethylene terephthalate), RSV: 0.67, and 240 g. of poly(ethylene dodecanedioate). The threads have the following textile characteristics:

Titer: 90/20 dtex
Tensile strength: 3.3 CN/dtex
Tensile elongation: 34%

See the table for the dye yield, the DSC analysis, and the RSV value of the threads.

EXAMPLE 4

2,850 g. of a dried poly(1,4-cyclohexylenedimethylene terephthalate), RSV value 0.80 dl./g., in granulated form, is mixed with 150 g. of the poly(ethylene dodecanedioate) granules produced according to Example 1. The mixture is spun in a laboratory spinning apparatus through a spinneret having 24 holes of a diameter of 0.5 mm. at a spinning temperature of 320° C. (product temperature in the spinning head) into threads wound up at a take-off speed of 640 m./min. Subsequently, the threads are drawn with the use of a heated iron in one step in the hot state at a drawing ratio of 1:2.7.

The threads then have the following textile properties:

Titer: 116/24 dtex
Tensile strength: 2.2 cN/dtex
Tensile elongation: 24%

See the table for dye yield, DSC analysis, and RSV value of the threads.

EXAMPLE 5

Example 4 is repeated with the use of a granulated mixture of 2,760 g. of poly(1,4-cyclohexylenedimethylene terephthalate), RSV value 0.80 dl./g., and 240 g. of poly(ethylene dodecanedioate). The threads have the following textile properties:

Titer: 110/24 dtex
Tensile strength: 2.1 cN/dtex
Tensile elongation: 25%

Dye yield, DSC analysis, and RSV value of the threads can be seen from the table.

COMPARATIVE EXAMPLE 1

Example 2 is repeated identically with the use of 3,000 g. of pure poly(ethylene terephthalate), RSV value 0.67 dl./g., thus obtaining the following threads:

Titer: 89/20 dtex
Tensile strength: 3.6 cN/dtex
Tensile elongation: 28%

Dye yield, DSC analysis, and RSV value of the threads can be seen from the table.

COMPARATIVE EXAMPLE 2

Example 4 is repeated identically with the use of 3,000 g. of pure poly(1,4-cyclohexylenedimethylene terephthalate), RSV 0.80 dl./g., thus obtaining the following threads:

Titer: 112/24 dtex
Tensile strength: 2.0 cN/dtex
Tensile elongation: 23%

Dye yield, DSC analysis, and RSV value of the threads can be derived from the table.

TABLE

| | | Dye Yield When Dyeing Without a Carrier [ % ] | | | DSC Analysis (*) | | |
|---|---|---|---|---|---|---|---|
| Example | % Poly(ethylene dodecanedioate) | "FORON" Yellow Brown 2 RFL | "Resolin" Red BBL | "Resolin" Blue RRL | $T_m$ [° C.] | $T_g$ [° C.] | RSV [dl./g.] |
| 2 | 5 | 95 | 96 | 96 | 250 | 70–79 | 0.63 |
| 3 | 8 | 97 | 98 | 98 | 249 | 70–78 | 0.64 |
| 4 | 5 | 97 | 98 | 98 | 290 | 87–95 | 0.74 |
| 5 | 8 | 99 | 99 | 99 | 289 | 87–94 | 0.74 |
| Comparative Example 1 | 0 | 20 | 25 | 20 | 251 | 72–81 | 0.62 |
| Comparative Example 2 | 0 | 70 | 70 | 70 | 292 | 89–96 | 0.69 |

(*) DSC Analysis: Differential Scanning Calorimetry
$T_m$: Crystalline melting point
$T_g$: Glass transition point

I claim:

1. Method for the production of polyester threads having increased dye affinity comprising:
   (a) mixing about 85–97% by weight of a polyester selected from the group consisting of poly(ethylene terephthalate) and poly(1,4-cyclohexylenedimethylene terephthalate) with about 3–15% by weight of poly(ethylene dodecanedioate);
   (b) spinning the mixture into threads; and
   (c) dyeing the spun threads.
2. The threads produced by the method of claim 1.
3. Textile articles woven from the threads of claim 2.

* * * * *